United States Patent [19]

Viets

[11] Patent Number: 4,872,529

[45] Date of Patent: Oct. 10, 1989

[54] LADDER STABILIZER ASSEMBLY

[76] Inventor: Michael I. Viets, 1647 N. Allen, Pasadena, Calif. 91104

[21] Appl. No.: 296,579

[22] Filed: Jan. 11, 1989

[51] Int. Cl.[4] ..... E06C 5/36

[52] U.S. Cl. ..... 182/172; 248/354.1

[58] Field of Search ..... 182/172, 169, 165, 170; 248/354.1

[56] References Cited

U.S. PATENT DOCUMENTS

| | | | |
|---|---|---|---|
| 2,997,127 | 8/1961 | Wojtowicz | 182/172 |
| 3,508,628 | 4/1970 | Conrad | 182/172 |
| 3,568,798 | 3/1971 | Pierce | 182/172 |
| 3,856,112 | 12/1974 | Stewart | 182/172 |
| 3,878,917 | 4/1975 | McBride | 182/172 |
| 3,901,354 | 8/1975 | Grebausky | 182/172 |
| 4,175,641 | 11/1979 | Reyes | 182/172 |
| 4,433,754 | 2/1984 | Beach | 182/172 |
| 4,625,832 | 12/1986 | Hartley | 182/172 |
| 4,641,729 | 2/1987 | Beck | 182/172 |

*Primary Examiner*—Reinaldo P. Machado

*Attorney, Agent, or Firm*—Sheldon & Mak

[57] ABSTRACT

A ladder stabilizer assembly for stabilizing a ladder is provided. The stabilizer assembly comprises a telescoping stabilizer pole which is attached at its upper end to the upper portion of the ladder side frame. The lower end of the stabilizer pole can be pivoted in two ways: away from the ladder side frame and within a plane which is parallel to the plane of the ladder side frame. The stabilizer pole has an inner member which slides within an outer member so that the stabilizer pole can be extended outwardly in telescope fashion. The inner member has a cam mechanism at the end which is within the outer pole member. The cam mechanism consists of a first rubber plug rigidly attached at the end of the inner member and a second rubber plug swivilably attached on a axis which is parallel to but not coincident with the longitudinal axis of the two plugs. The cam mechanism allows the inner member to be locked relative to the outer pole member by rotating the lowermost stabilizer pole member by about 90°.

22 Claims, 4 Drawing Sheets

FIG. 1
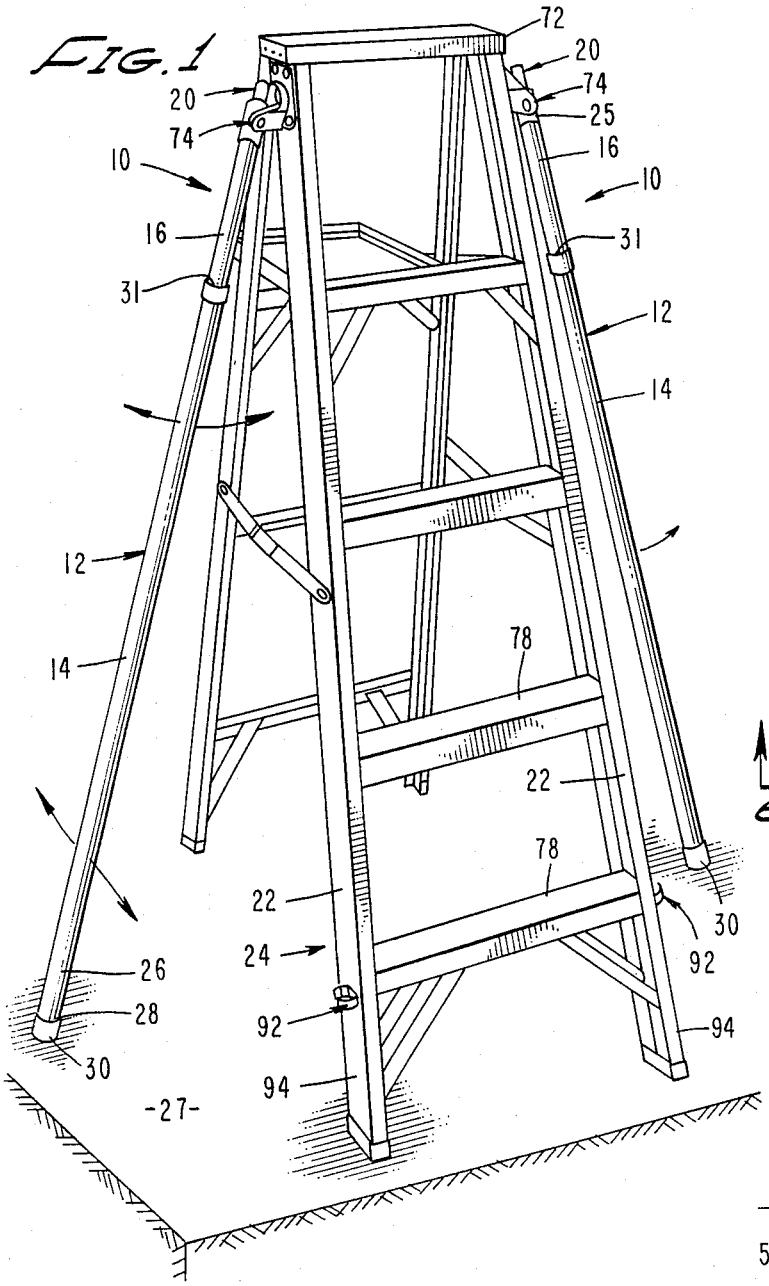
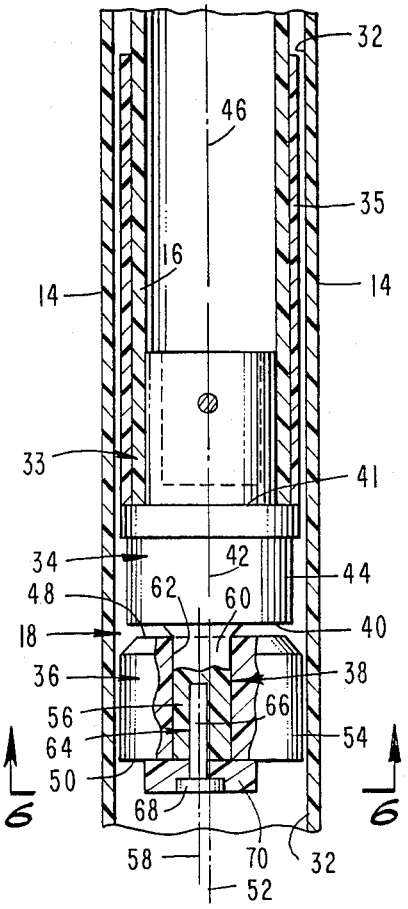
FIG. 5
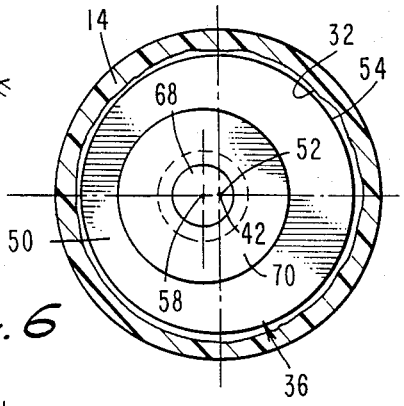
FIG. 6
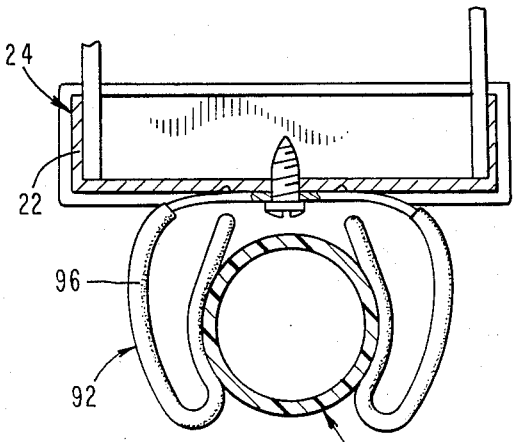
FIG. 4
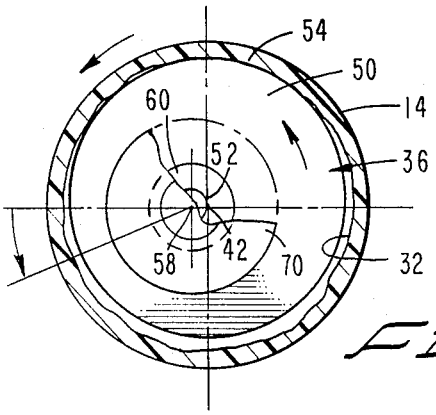
FIG. 7

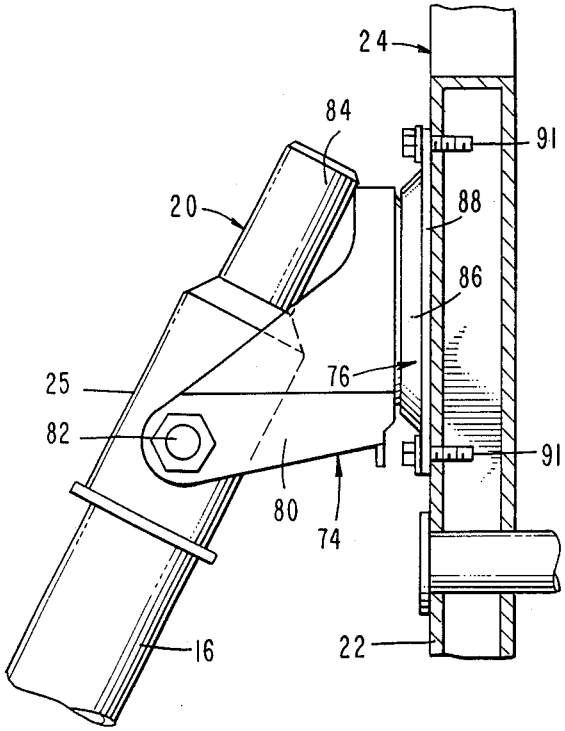
FIG. 13
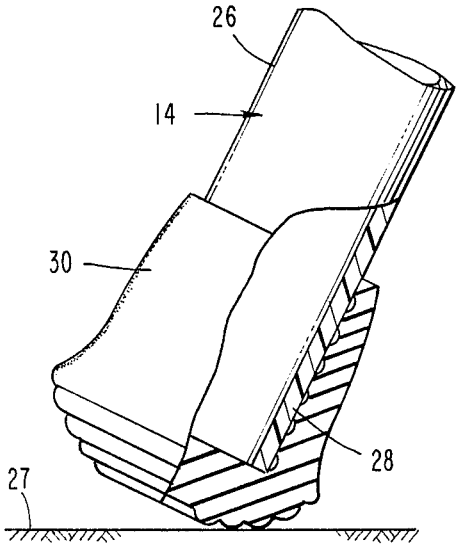
FIG. 14
FIG. 12
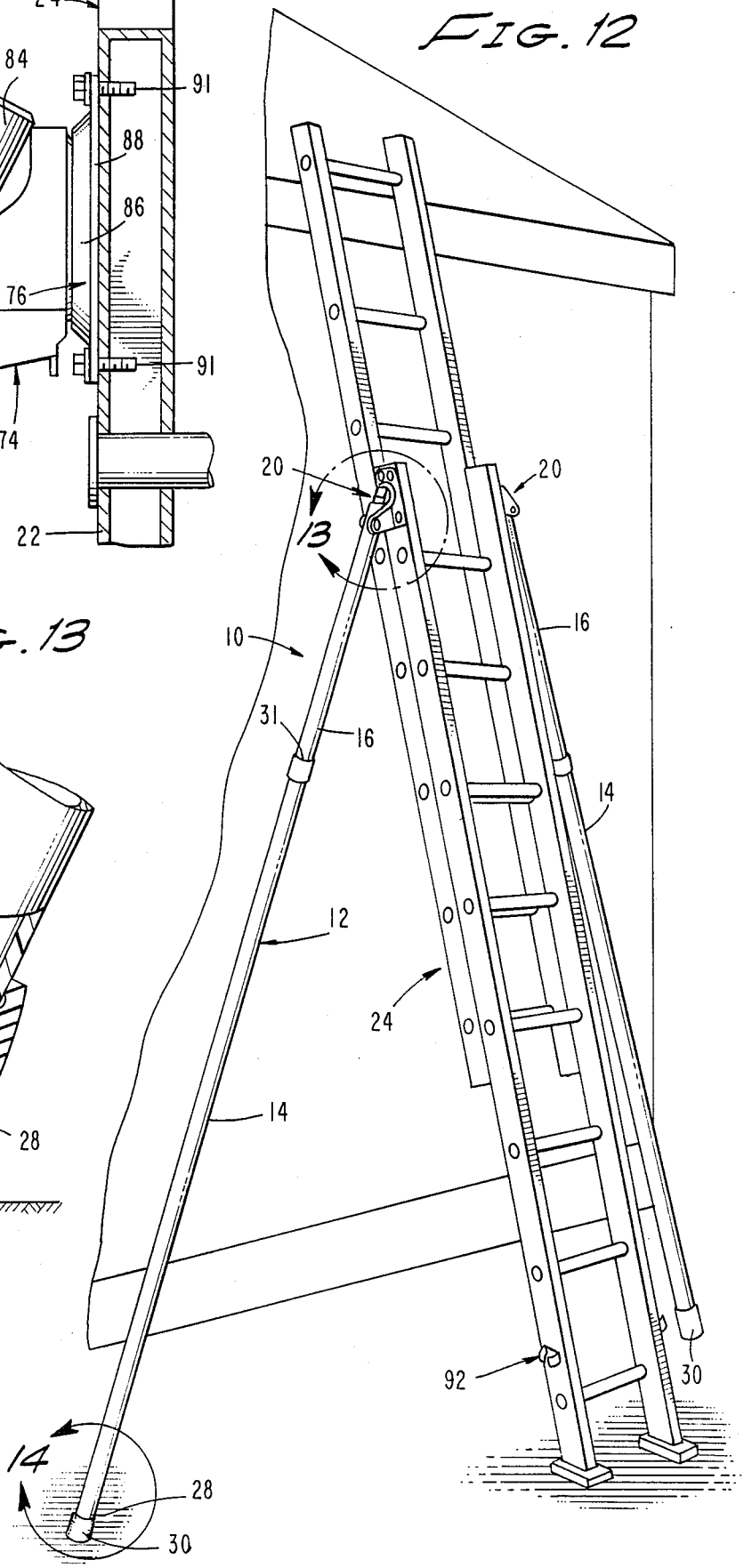

LADDER STABILIZER ASSEMBLY

FIELD OF THE INVENTION

This invention relates generally to the field of ladder equipment and more specifically to the field of stabilizing devices for ladders.

BACKGROUND

Use of ladders has always entailed the danger of falling off of the ladders due to the side-ways tipping of the ladder. This is because the combination of a ladder and an individual standing on the ladder has a high center of gravity relative to the width of the ladder base.

The prior art is replete with attempts to minimize this danger. One such attempt involves the appending to a ladder of adjustable outrigger arms to provide the ladder with an effectively wider base. Examples of these attempts can be found in U.S. Pat. Nos. 2,997,127, 3,878,917, 4,175,641, 4,433,754, 4,625,832 and 4,641,729.

The problem with these prior art attempts is that they provide devices which tend to be cumbersome, limited, awkward, complex, and difficult and/or time consuming to adjust.

There is therefore a need for a ladder stabilizing assembly which is light, non-cumbersome, simple in construction, versatile and quick and easy to adjust.

SUMMARY

The ladder stabilizer assembly of the invention satisfies this need.

The ladder stabilizer assembly includes: (a) a stabilizer pole having: (i) a cylindrical, hollow outer pole member; and (ii) a cylindrical inner pole member; the external diameter of the inner pole member being substantially the same as the internal diameter of the outer pole member so that the inner pole member is longitudinally slidable within the outer pole member; (b) cam means for alternatively locking and unlocking the inner pole member within the outer pole member, the cam means comprising: (i) a first flexible cylindrical plug attached to one end of the inner sole member and having a diameter which is substantially the same as the external diameter of the first pole member; (ii) a second flexible cylindrical plug having substantially the same diameter as the diameter of the first plug; and (iii) plug attachment means for attaching the first plug to the second plug so that the radial surface of the first plug is parallel to the radial surface of the second plug and so that the first plug and the second plug are alternatively rotatable about a common axis between an unlocked position, wherein longitudinal axis of the first plug is coincident with the longitudinal axis of the second plug, and a locked position, wherein the longitudinal axis of the first plug is not coincident with the longitudinal axis of the second plug; and (c) attachment means for attaching the upper end of the stabilizer pole to the upper end of the ladder side frame, the attachment means comprising: (i) hinge means for pivoting the lower end of the stabilizer pole away from the plane of the ladder side frame to an angle of at least about 30°; and (ii) swivel means for pivoting the lower end of the stabilizer pole away from either side of a vertical plane running through the upper end of the ladder side frame and disposed perpendicular to the ladder side frame to angles of about ±45°.

The ladder stabilizer assembly of the invention provides a simple and inexpensive method for the stabilizing of conventional ladders. It is lightweight and conveniently appended to the sides of a ladder without interfering with the functionality of the ladder. The ladder stabilizer assembly of the invention is also highly versatile and it is quickly and easily adjusted, in some cases, even while standing upon the ladder.

The invention is also a ladder and a ladder stabilizing method using the ladder stabilizer assembly described above.

DRAWINGS

These and other features, aspects and advantages of the present invention will become understood with reference to the following description, appended claims and accompanying drawings where:

FIG. 1 a perspective view of a ladder and a ladder stabilizing base having features of the invention;

FIG. 4 is a cross-sectional top view of the ladder and ladder stabilizing assembly of FIG. 1;

FIG. 5 is a cross-sectional drawing of a stabilizer pole useful in the invention showing in detail the cam-actuated locking and unlocking assembly;

FIG. 6 is a cross-sectional view of the cam assembly shown in FIG. 5, the cross-section being taken across plane 6-6;

FIG. 7 is a cross-sectional view of the cam assembly shown in FIG. 5, the drawing providing, in schematic form, the locking and unlocking action of the cam assembly;

FIG. 20 is a perspective view of the ladder and ladder stabilizer assembly shown in FIG. 1, illustrating the method of adjusting the stabilizer pole;

FIG. 12 is a perspective view of an extension ladder and ladder stabilizer assembly having features of the invention;

FIG. 13 is a cross-sectional side view of the top of the ladder side frame showing the attachment of a ladder stabilizer assembly having features of the invention to the ladder frame; and FIG. 14 is a cross-sectional drawing of a non-skid cap shown in FIG. 12.

DESCRIPTION

Figure 2:
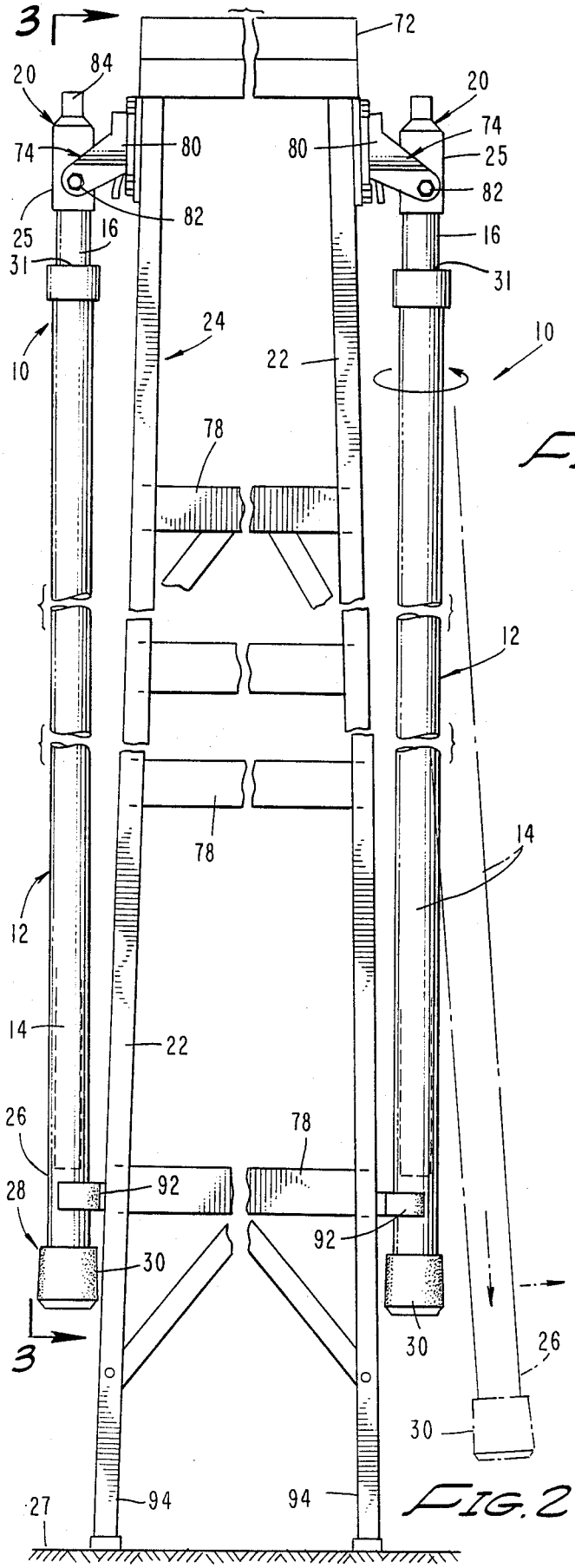
FIG. 2 is a front view of the ladder and ladder stabilizer assembly of FIG. 1.

The ladder stabilizer assembly 10 of the invention comprises (i) at least one telescoping stabilizer pole 12 having a cylindrical, hollow outer pole member 14 and a cylindrical inner pole member 16, (ii) cam means 18 for alternatively locking and unlocking the inner pole member 16 within the outer pole member 14, and (iii) attachment means 20 for attaching the stabilizer pole 12 to the side frame 22 of the ladder 24.

The stabilizer pole 12 can be constructed of any suitable rigid material. The stabilizer pole 12 can be constructed of metals, plastics, and composite materials. Preferably, to minimize the danger of electrical accidents, the material is electrically non-conducting. Also preferably, the stabilizer pole 12 is constructed of a material which will not kink once subjected to high bending stresses. One of the most preferred materials for the construction of the stabilizer pole 12 is fiberglass because of its high strength-to-weight ratio, because it is electrically non-conducting and because it will not tend to kink when subjected to high bending stresses.

The diameter of the stabilizer pole 12 is not critical. Depending upon the material of which the stabilizer pole 12 is constructed, the diameter should, however, be large enough to provide sufficient strength to the pole 12 without being unduly heavy or awkward.

The stabilizer pole 12 has an upper end 25 and a lower end 26. The minimum length of the stabilizer pole 12 should be sufficiently short so that, when the stabilizer pole 12 is affixed to the side frame 22 of the ladder 24, the stabilizer pole 12 does not extend below the foot of the ladder side frame 22. The maximum length of the stabilizer pole 12 should be sufficient to allow the pole 12 to pivot laterally outward from the side of the ladder frame 22 to angles of at least about 30° and still reach the ground or other base surface 27. Preferably, the maximum length of the stabilizer pole 12 should be sufficient to reach to the ground 27 when the pole 12 is pivoted away from the ladder frame 22 to angles up to about 60°. Such length gives the ladder stabilizer assembly 10 the versatility to provide a stable ladder position whether or not the ground or other base surface 27 is even.

The lower-most end 28 of the stabilizer pole 12 can have a non-skid surface to prevent the pole 12 from slipping. Preferably the lower-most end 28 of the stabilizer pole 12 comprises a cap 30 composed of rubber or some other highly non-skid material. Most preferably, the cap 30 is ribbed as illustrated in FIG. 14 to impart to the cap 30 a highly non-skid character, even when the cap 30 is urged against a horizontal surface 27 at an angle less than 90°. It has been found that a crutch tip such as that sold by Rubbercraft Corporation of Torrance, Calif. can be effectively used as the cap 30 in the invention.

The outer pole member 14 of the stabilizer pole 12 is a hollow cylinder having an open end 31 for receiving in "telescope" fashion the inner pole member 16. The outer pole member 14 has an internal diameter and an inner surface 32.

The inner pole member 16 has an external diameter which is approximately the same as the internal diameter of the outer pole member 14. This allows a first end 33 of the inner pole member 16 to slide, in telescope fashion, within the outer pole member 14. The inner pole member 16 can be solid to impart maximum rigidity to the stabilizer pole 12.

A sleeve 35 can be concentrically disposed between the first end 33 of the inner pole member 16 and the inner surface 32 of the outer pole member 14 to decrease friction between the first end 33 of the inner pole member 16 and the inner surface 32 of the outer pole member 14 and to facilitate a smooth telescoping interaction between the inner pole member 16 and the outer pole member 14.

The stabilizer pole 12 can be attached to the side frame 22 of the ladder 24 either at the free end of the inner pole member 16 (wherein the inner pole member 16 is the uppermost moiety of the stabilizer pole 12 and the outer pole member 14 is the lower-most moiety of the stabilizer pole 12), or at the free end of the outer pole member 14 (wherein the outer pole member 14 is the upper-most moiety of the stabilizer pole 12 and the inner pole member 16 is the lower-most moiety of the stabilizer pole 12). Preferably, the stabilizer pole 12 is attached to the side frame 22 of the ladder 24 at the free end of the inner pole member 16. As will become more apparent from the discussion of the locking mechanism described below, for stabilizer poles 12 of equivalent maximum and minimum lengths, attaching the stabilizer pole 12 to the ladder side frame 22 at the free end of the inner pole member 16 allows the length of the stabilizer pole 12 to be adjusted conveniently near the uppermost end of the stabilizer pole 12.

The cam means 18 for locking and unlocking the outer pole member 14 relative to the inner pole member 16 comprises a first flexible cylindrical plug 34, a second flexible cylindrical plug 36 and plug attachment means 38 for attaching the first plug 34 to the second plug 36.

The first flexible cylindrical plug 34 has a first end 40, a second end 42 disposed opposite the first end 40, a diameter, a first plug longitudinal axis 42 and a radial surface 44 parallel to the first plug longitudinal axis 42. The diameter of the first plug 34 is substantially the same as the external diameter of the first end 33 of the inner pole member 16, and the second end 42 of the first plug 34 is attached to the first end 33 of the inner pole member 16 such that the longitudinal axis 46 of the inner pole member 16 is coincident with the longitudinal axis 42 of the first plug 34.

Likewise, the second flexible cylindrical plug 36 has a first end 48, a second end 50 disposed opposite the first end 48, a diameter, a longitudinal axis 52, and a radial external surface 54 parallel to the second plug longitudinal axis 42. The diameter of the second plug 36 is substantially the same as the diameter of the first plug 34.

The first and second plugs 34 and 36 can be made out of any resilient and non-skid material such as rubber or a rubber-like plastic. The lengths of the plugs 34 and 36 are not critical. Lengths between about ½ inch and 2 inches can be used.

The plug attachment means 38 can be a pin or axle 56 and is adapted to attach the first plug 34 to the second plug 36 so that the radial surface 44 of the first plug 34 is parallel to the radial surface 54 of the second plug 36 and so that the first end 40 of the first plug 34 and the first end 48 of the second plug 36 are alternatively rotatable about a common axis 58 between an unlocked position, wherein the first plug longitudinal axis 42 is coincident with the second plug longitudinal axis 52 (as shown in FIGS. 5 and 6), and a locked position, wherein the first plug longitudinal axis 42 is not coincident with the second plug longitudinal axis 52 (as shown in FIG. 7).

The plug attachment means 38 can comprise a rigid cylinder 60 attached to the first end 40 of the first plug 34 and having a longitudinal axis 58 which is parallel with, but not coincident with, the longitudinal axis 42 of the first plug 34. The rigid cylinder 60 protrudes through a bore 62 within the second plug 36. Such bore 62 has a longitudinal axis 58 which is parallel with, but not coincident with, the longitudinal axis 52 of the second plug 36. The second plug 36 is rotatably attached to the rigid cylinder 60 by an attaching pin 64 having a shaft 66 and a head 68. The head 68 of the attaching pin 66 is spaced apart from the second end 50 of the second plug 36 by a washer 70.

The distance between the longitudinal axis 58 of the rigid cylinder 60 and the longitudinal axis 52 of the second plug 36 is sufficiently small and the distance between the radial surface 54 of the second plug 36 and the inner surface 32 of the outer pole member 14 is sufficiently large so that the second plug 36 can be alternatively rotated about the rigid cylinder 60 between the locked position, wherein the radial surface 54 of the second plug 36 impinges upon the inner surface 32 of the outer pole member 14, and the unlocked position, wherein the radial surface 54 of the second plug 36 does not impinge upon the inner surface 32 of the outer pole member 14. The impingement of the second flexible plug 36 with the inner surface 32 of the outer pole member 14 causes the flexible second plug 36 to "grip" the inner surface 32 of the outer pole member 14 and thereby lock the outer pole member 14 to the inner pole member 16.

Preferably, the inner surface 32 of the outer pole member 14 is roughened (i.e., unsmooth) to minimize slippage between the second flexible plug 36 and the inner surface 32 of the outer pole member 14.

The attachment means 20 for attaching the stabilizer pole 12 to the ladder side frame 22 is adapted to attach the upper end 25 of the stabilizer pole 12 to the upper end 72 of the ladder side frame 22.

Figure 3:
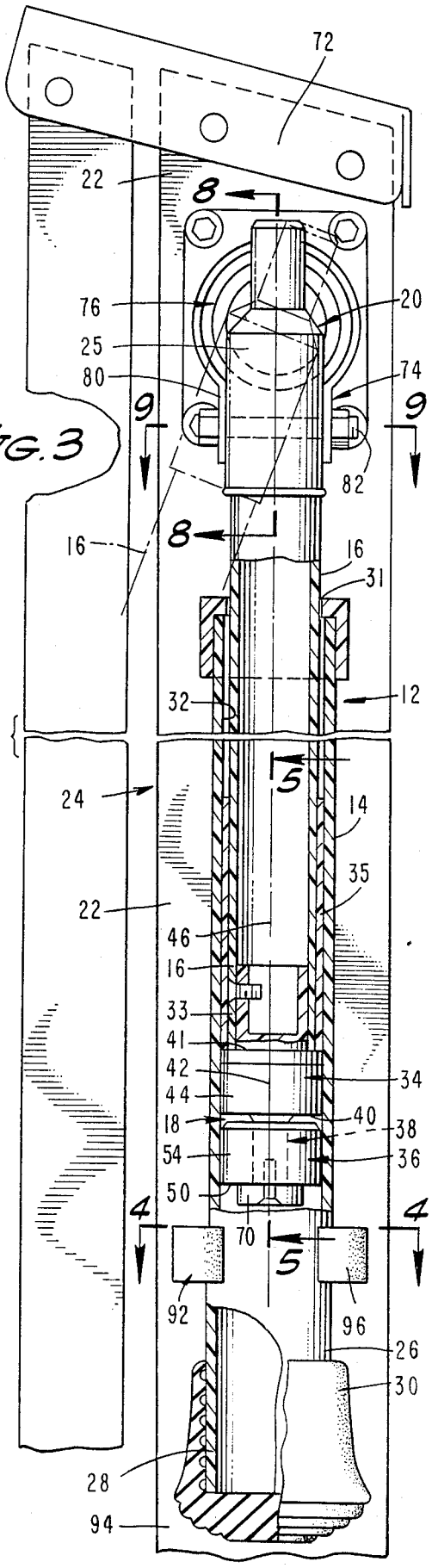
FIG. 3 is a side view of the ladder and ladder stabilizer assembly of FIG. 1, the ladder stabilizer assembly being shown in partial cross-section.

The attachment means 20 comprises hinge means 74 for pivoting the lower end 26 of the stabilizer pole 12 away from the plane of the ladder side frame 22 to an angle of at least about 30° and swivel means 76 for pivoting the lower end 26 of the stabilizer pole 12 away from either side of a vertical plane running through the upper end 72 of the ladder side frame 22 and disposed perpendicular to the plane of the ladder side frame 22 to angles of at least about ±45°. (The swivel means 76 therefore allows a stabilizer pole 12 attached at its upper end 26 to the upper end 72 of the ladder side frame 22 to pivot, when viewed from the side of the ladder 24 (as in FIG. 3), to the left to about 45° from the vertical and to the right to about 45° from the vertical.) The plane of the ladder side frame 22 is that plane disposed vertically through the ladder side frame 22 and perpendicular to the rungs 78 of the ladder 24.

Preferably the hinge means 74 allows the stabilizer pole 12 to pivot away from the plane of the ladder side frame 22 to an angle of at least about 45°. This permits additional stability due to the increased effective base width of the ladder/stabilizer assembly combination. Most preferably, the hinge means 74 allows the stabilizer pole 12 to pivot away from the plane of the ladder side frame 22 to an angle of at least about 60°. This gives the ladder/stabilizer assembly combination additional increased versatility and the ability to impart a maximum of stability to the ladder 24 due to the very wide effective base of the ladder/stabilizer assembly combination.

Figure 8:
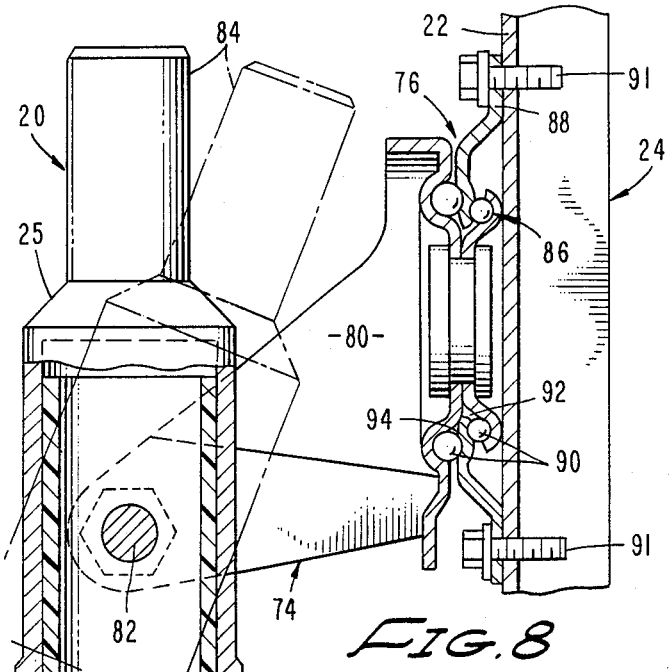
FIG. 8 is a cross-sectional drawing of the hinge and swivel mechanism portions of the stabilizer assembly shown in FIG. 1.
Figure 10:
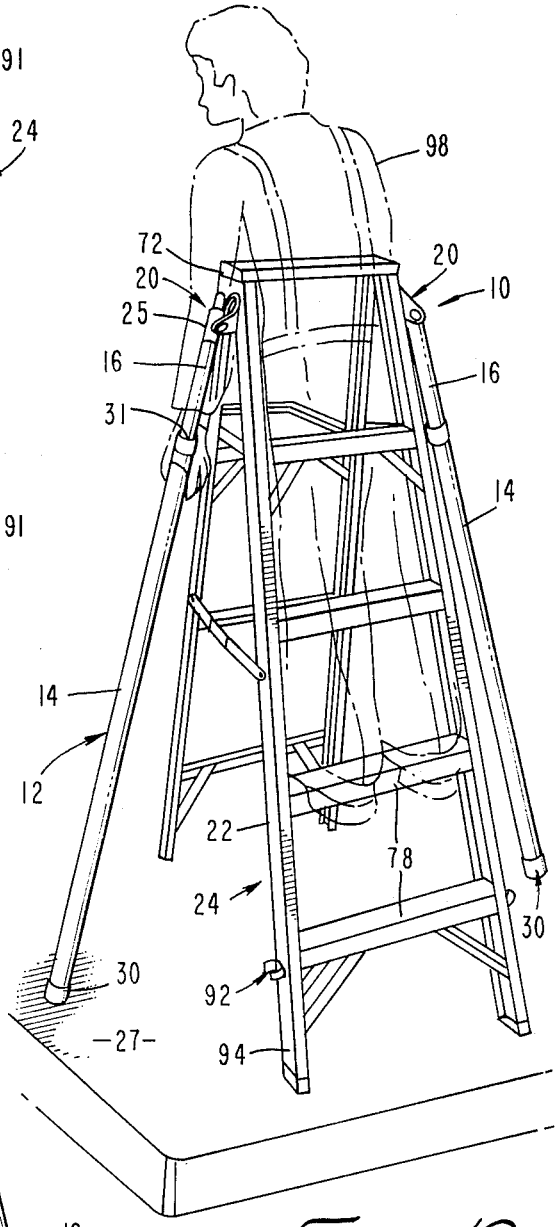
Figure 11:
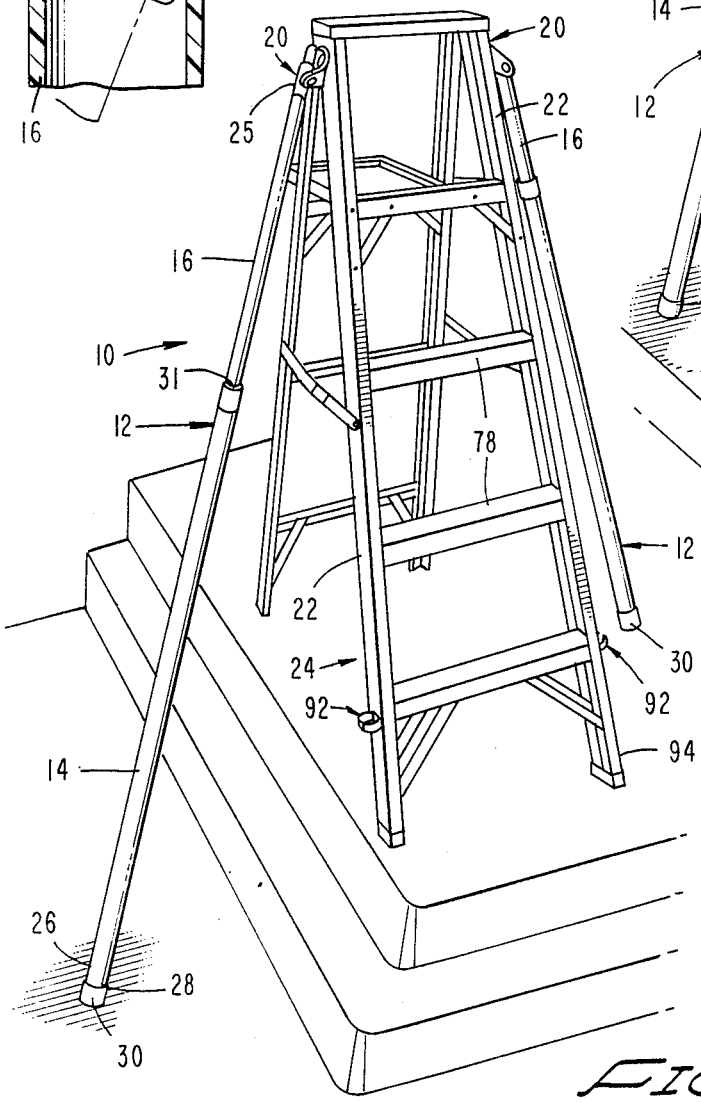
FIG. 11 is a perspective view of the ladder and ladder stabilizer assembly shown in FIG. 1, one stabilizer pole of the ladder stabilizer assembly being shown in an extended position.
Figure 9:
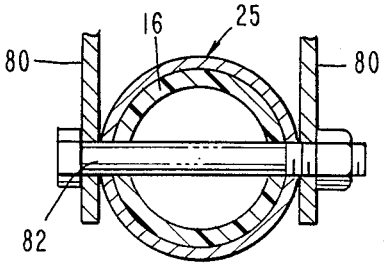
FIG. 9 is a cross-sectional top view of the stabilizer pole shown in FIG. 1, the cross-section being taken near the top of the pole at the hinge pin location.

The hinge means 74 can be any hinge mechanism suitable for allowing the stabilizer pole 12 to pivot away from the plane of the ladder side frame 22. As illustrated in FIG. 8, the hinge means 74 can comprise a forked hinge bracket 80 adapted to hold a horizontal pin 82 disposed laterally through the diameter of the stabilizer pole 12, the horizontal pin 82 being adapted to allow the stabilizer pole 12 to rotate about the pin 82.

The hinge means 74 can also comprise a stop means 84 for mechanically preventing the stabilizer pole 12 from pivoting beyond some predetermined angle. In the embodiment shown in the drawings, such a stop is provided by the impingement of the uppermost portion of the stabilizer pole 12 against the hinge bracket 80 as illustrated, for instance, in FIG. 13.

The swivel means 76 can be any device suitable for allowing rotational movement of the stabilizer pole 12 relevant to a vertical plane disposed through the upper end 72 of the ladder side frame 22 and disposed perpendicular to the plane of the ladder side frame 22. Preferably, the swivel means 76 comprises a ball bearing mechanism 86 rotatably connecting the hinge means 74 to a base plate 88. As shown in FIG. 8, the swivel means 76 can comprise two separate layers of steel balls 90 in a first raceway 92 and a second raceway 94. A hinge means 74 and swivel means 76 combination suitable in the invention is a conventional heavy-duty furniture caster with the caster wheel removed, the caster axle being used as the horizontal pin 82.

Preferably the swivel means 74 allows the stabilizer pole 12 to swivel relative to the plane disposed through the upper end 72 of the ladder side frame 22 and perpendicular to the plane of the ladder side frame 22 by angles of at least ±90°. The increased permissible angle gives the ladder 24 increased versatility in that it allows the stabilizer pole 12 to be used against surfaces disposed laterally from the ladder, such as vertical building surfaces. For optimum versatility, the swivel means 76 permits the rotation of the stabilizer pole 12 relative to the vertical plane running through the upper end 72 of the ladder side frame 22 and disposed perpendicular to the plane of the ladder side frame 22 ±180°, in other words, capable of near free rotation about the upper end 72 of the ladder side frame 22. This permits use of the stabilizer pole 12 with any suitable nearby surface, whether disposed above or below the upper end 72 of the ladder side frame 22.

As illustrated in the drawings, the attachment means 20 for attaching the stabilizer pole 12 to the ladder side frame 22 can also comprise a base plate 88 attachable to the ladder 24 by bolts, screws or other suitable connection means 90. The base plate 88 is either connected to the swivel means 76 which, in turn, is connected to the hinge means 74, or the base plate 88 is connected to the hinge means 74 which is, in turn, connected to the swivel means 76.

The ladder stabilizer assembly 10 can also comprise clip means 92 attached to the lower side frame end 94 of the ladder 24 and adapted to alternatively affix and de-affix the lower end 26 of the stabilizer pole 12 to the ladder side frame 22. A typical clip 96 suitable as the clip means 92 in the invention is illustrated, for instance, in FIG. 4. The clip 96 is a shaped length of a resilient material such as a metal or resilient plastic. The clip 96 is shaped to alternatively accept and allow the removal of the stabilizer pole 12. When the stabilizer pole 12 is within the clip 96, the resilient sides of the clip 96 grip the periphery of the stabilizer pole 12. Because of the spring-like nature of the clip 96, the stabilizer pole 12 can be easily removed from the clip 96 and, alternatively, reinstalled within the clip 96.

The stabilizer assembly of the invention 10 is suitable for use with any conventional ladder 12 having side frames 22, including step ladders, extension ladders and one-piece ladders.

In operation, a user 98 of a ladder 24 comprising two stabilizer assemblies of the invention 10, one attached to each of the two sides 22 of the ladder 24, first places the ladder 24 at the desired location on a reasonably flat surface 27. The user 98 then detaches the lower ends 26 of the stabilizer poles 12 from the clip means 92 and pivots the lower ends 26 of the stabilizer poles 12 away from the ladder 24 and so that the stabilizer poles 12 are disposed within vertical planes. After pivoting the lower ends 26 of the stabilizer poles 12 away from the ladder 12 to suitable angles, such as between about 30° and about 60°, the lower-most moieties of the stabilizer poles 12 are rotated from the locked position to the unlocked position and the lower-most moieties of the stabilizer poles 12 are extended outwardly until they become in firm contact with some suitable surface. The lower-most moieties of the stabilizer poles 12 are then rotated from the unlocked position to the locked position and the ladder 24 is suitably stabilized.

After the user 98 mounts the ladder 24, if the user 98 finds that the ladder has a slight wobble, the user 98 may adjust the length of one or both of the stabilizer poles 12 while still on the ladder 24 by reaching down and carefully rotating the lower-most moiety of one or both of the stabilizer poles 12 from the locked position to the unlocked position, further extending the lower-most moiety of the stabilizer pole 12 to place the lower-most moiety of the stabilizer pole 12 in firmer contact with the surface and then again rotating the lower-most moiety of the stabilizer pole 12 from the unlocked position to the locked position.

EXAMPLE

An exemplar ladder 24 and stabilizer assembly of the invention 10 comprises a step ladder 24 having side frames 22 60 inches long and 5 rungs 78 spaced about 12 inches apart. When fully opened, the step ladder 24 stands about 58 inches high. The rungs 78 are approximately 15 inches long.

The stabilizer pole 12 of the stabilizer assembly 10 has an outer pole member 14 which is 48 inches long, has an outside diameter of 1¼ inches, and has an inside diameter of 1 1/16 inches. The inner pole member 16 is 48 inches long, and has an outside diameter of about 1 inch.

The stabilizer pole 12 is attached to the ladder 24 with the outer pole member 14 at the bottom and the inner pole member 16 at the top. The lower-most extremity 28 of the stabilizer pole 12 is capped with a ribbed rubber crutch tip 30.

The stabilizer pole 12 is made of fiberglass. The inner pole member 16 is solid.

The attachment means 20 is a heavy duty furniture caster which has had its wheel removed. The caster includes a base plate 88 which is 1/16 inches thick, a double race ball bearing swivel means capable of full, 360° rotation. The hinge means 74 comprises a pin 82 disposed where the axle of the wheel of the caster would normally be attached. The pin 82 extends laterally through the upper-most end of the inner pole member 16.

The hinge means 74 is capable of pivoting the lower portion 26 of the stabilizer pole 12 away from the plane of the ladder side frame 22 continuously between angles of about 0° and about 30°.

The exemplar ladder 24 further comprises a plastic coated steel spring clip 96 disposed at the base of the ladder side frame 22 and adapted to alternatively attach and de-attach the stabilizer pole 12 to and from the lower portion 94 of the ladder side frame 22.

When the outer pole member 14 is fully retracted about the inner pole member 16, the length of the stabilizer pole 12 is 50 inches. When the outer pole member 14 is fully extended, the length of the stabilizer pole 12 is 92 inches.

Although the present invention has been described in considerable detail with reference to certain preferred versions, other versions are possible. Therefore, the spirit and scope of the appended claims should not necessarily be limited to the description of the preferred versions contained herein.

I claim:

1. A ladder stabilizer assembly for stabilizing a ladder, the ladder having at least one side frame disposed in a vertical side frame plane, the side frame having an upper side frame end and a lower side frame end, the stabilizer assembly comprising:

(a) a stabilizer pole having an upper end and a lower end and comprising:

(i) a cylindrical, hollow outer pole member having an internal surface and an internal diameter; and (ii) a cylindrical inner pole member having a first end, a second end, and an external diameter: the external diameter of the inner pole member being substantially the same as the internal diameter of the outer pole member, the first end of the inner pole member being longitudinally slidable within the outer pole member;

(b) cam means for alternatively locking and unlocking the first end of the inner pole member within the outer pole member, comprising:

(i) a first flexible cylindrical plug having a first end, a second end disposed opposite the first end, a diameter, a first plug longitudinal axis, and a radial surface parallel to the first plug longitudinal axis; the diameter of the first plug being substantially the same as the external diameter of the first end of the inner pole member; and the second end of the first plug being attached to the first end of the inner pole member such that the longitudinal axis of the inner pole member is coincident with the longitudinal axis of the first plug;

(ii) a second flexible cylindrical plug having a first end, a second end disposed opposite the first end, a diameter, a longitudinal axis, and a radial external surface parallel to the second plug longitudinal axis; the diameter of the second plug being substantially the same as the diameter of the first plug; and (iii) plug attachment means for attaching the first plug to the second plug so that the radial surface of the first plug is parallel to the radial surface of the second plug and so that the first end of the first plug and the first end of the second plug are alternatively rotatable about a common axis between an unlocked position, wherein the first plug longitudinal axis is coincident with the second plug longitudinal axis, and a locked position, wherein the first plug longitudinal axis is not coincident with the second plug longitudinal axis and wherein the radial external surface of the second plug impinges upon the inner surface of the outer pole member; and (c) attachment means for attaching the upper end of the stabilizer pole to the upper end of the ladder side frame, comprising:

(i) hinge means for pivoting the lower end of the stabilizer pole away from the plane of the ladder side frame to an angle of at least about 30°; and (ii) swivel means for pivoting the lower end of the stabilizer pole away from either side of a vertical plane running through the upper end of the ladder side frame and disposed perpendicular to the plane of the ladder side frame to angles of at least about ±45°.

2. The ladder stabilizer assembly of claim 1 further comprising clip means attached to the lower side frame end for alternatively affixing and de-affixing the lower end of the stabilizer pole to the side frame.

3. The ladder stabilizer assembly of claim 1 wherein the lower-most end of the stabilizer pole has a non-skid surface.

4. The ladder stabilizer assembly of claim 1 wherein the lower end of the stabilizer pole comprises a rubber cap having a ribbed surface.

5. The ladder stabilizer assembly of claim 1 wherein the outer pole member comprises the lower end of the stabilizer pole.

6. The ladder stabilizer assembly of claim 1 wherein the inner pole member is substantially solid.

7. The ladder stabilizer assembly of claim 1 wherein the stabilizer pole is composed of a electrically non-conducting material.

8. A ladder stabilizer assembly of claim 1 wherein the stabilizer pole is composed of fiberglass.

9. The ladder stabilizer assembly of claim 1 wherein the hinge means comprises a pin rotatably affixed to the swivel means, the pin being disposed laterally through the upper end of the stabilizer pole.

10. The ladder stabilizer assembly of claim 1 wherein the hinge means allows the lower end of the stabilizer pole to pivot away from the plane of the ladder side frame to an angle of at least about 45°.

11. The ladder stabilizer assembly of claim 1 wherein the hinge means allows the lower end of the stabilizer pole to pivot away from the plane of the ladder side frame to an angle of at least about 60°.

12. The ladder stabilizer assembly of claim 1 wherein the swivel means for pivoting the lower end of the stabilizer pole allows the lower end of the stabilizer pole to pivot away from either side of the vertical plane running through the upper end of the ladder side frame and disposed perpendicular to the plane of the ladder side frame to angles of at least about ±90°.

13. The ladder stabilizer assembly of claim 1 wherein the swivel means for pivoting the lower end of the stabilizer pole allows the lower end of the stabilizer pole to pivot away from either side of the vertical plane running through the upper end of the ladder side frame and disposed perpendicular to the plane of the ladder side frame to angles of at least about ±180°.

14. The ladder stabilizer assembly of claim 1 wherein the swivel means comprises ball bearings to minimize friction during swiveling operations.

15. The ladder stabilizer assembly of claim 1 wherein the swivel means comprises a furniture caster.

16. The ladder stabilizer assembly of claim 1 wherein the interior surface of the outer pole member is roughened.

17. The ladder stabilizer assembly of claim 1 wherein the first plug and the second plug are composed of rubber.

18. A ladder having oppositely-disposed side frames disposed in parallel side frame planes, each side frame having an upper side frame end and a lower side frame end; the ladder comprising a pair of the ladder stabilizer assemblies defined in claim 1; each stabilizer assembly being attached to the upper side frame end of the ladder with the stabilizer assembly attachment means.

19. The ladder of claim 18 wherein the ladder is a step ladder.

20. The ladder of claim 18 wherein the ladder is an extension ladder.

21. A method for stabilizing a ladder having a pair of oppositely-disposed side frame members disposed in parallel side frame planes, each side frame member having an upper side frame end and a lower side frame end, the method comprising the steps of:

(a) affixing at least one ladder stabilizing assembly defined in claim 5 to the ladder by using the stabilizer assembly attachment means to attach the upper end of the stabilizer pole to one of the two upper side frame ends;

(b) rotating the outer pole member to the unlocked position;

(c) pivoting the lower end of the stabilizer pole away from the plane of the ladder side frame to an angle between about 15° and about 45°;

(d) sliding the outer pole member along the inner pole member to extend the length of the stabilizer pole until the lower end of the stabilizer pole is placed in contact with a stable surface; and (e) rotating the outer pole member to the lock position.

22. A method for stabilizing a ladder having a pair of oppositely-disposed side frame members disposed in parallel side frame planes, each side frame member having an opposite side frame end, a lower side frame end and at least one ladder stabilizing assembly defined in claim 5; the stabilizing assembly being attached at the upper end of the stabilizer pole to one of the two upper side frame ends; the method comprising:

(a) rotating the outer pole member to the unlocked position;

(b) pivoting the lower end of the stabilizer pole away from the plane of the ladder side frame to an angle between about 15° and about 45°;

(c) sliding the outer pole member along the inner pole member to extend the length of the stabilizer pole until the lower end of the stabilizer pole is placed in contact with a stable surface; and (d) rotating the outer pole member to the lock position.

* * * * *